US005496237A

United States Patent [19]

Hensley

[11] Patent Number: 5,496,237

[45] Date of Patent: Mar. 5, 1996

[54] BICYCLE TRAINING APPARATUS

[76] Inventor: Stanley A. Hensley, 2551 Driftwood, Pueblo, Colo. 81005

[21] Appl. No.: 436,888

[22] Filed: May 8, 1995

[51] Int. Cl.[6] ..... A63B 69/16; A63G 17/00

[52] U.S. Cl. ..... 482/57; 280/828; 472/113; 472/105

[58] Field of Search ..... 482/57, 110, 51; 280/1.181, 1.182, 1.183, 1.175, 828, 1.191; 472/105, 113

[56] References Cited

U.S. PATENT DOCUMENTS

| | | | |
|---|---|---|---|
| 864,728 | 8/1907 | Fouts | 472/113 |
| 2,903,262 | 9/1959 | Stukenborg | 472/105 |
| 2,968,483 | 1/1961 | Dodson | 472/105 |
| 5,156,650 | 10/1992 | Bals | 482/57 |
| 5,306,218 | 4/1994 | Huang Chen | 280/1.182 |

*Primary Examiner*—Stephen R. Crow
*Attorney, Agent, or Firm*—Ogram & Teplitz

[57] ABSTRACT

An exercise apparatus which also serves as an effective training device for mountain bikers. The invention utilizes a frame resembling that of a bicycle's frame. The frame supports handle bars having a gripping portion and two foot pedals. Each pedal is fixable to the frame and adjustable in height. Each foot pedal further has an abrasive upper surface for contact with the sole of a user's shoe. This abrasive upper surface acts to prevent slippage of the user's foot from the pedal. The frame is supported by two legs, one supporting the front part of the frame, the second supporting the rear part of the frame. Each leg is rotatably attached to the frame and oriented in a diagonal direction. The range of motion of each leg is limited by a compression spring which further acts to rotate the legs to their extended state after an external force causes them to retract. When in use, downward force exerted by the user on the invention's foot pedals and handle bars causes a corresponding force on each compression spring and retraction of each leg. The compression spring then reacts by exerting a corresponding downward force and extends the leg, thereby thrusting the frame and, therefore, the user upward. Through this action, the user is able to repeatedly hop from location to location at a variety of angles in addition to hopping on one leg at a time. The invention not only serves as an effective exercise device, but provides a means for a realistic simulation of the activity of mountain biking.

20 Claims, 2 Drawing Sheets

BICYCLE TRAINING APPARATUS

BACKGROUND OF THE INVENTION

This invention relates to bicycles and, more specifically, to training equipment for mountain bikers.

As those who have engaged in this activity know, mountain biking is a unique sport which places unique demands on the rider's body. It differs from traditional biking in that, not only is it an aerobic activity, but it also requires a certain amount of physical dexterity and strength on the part of the rider. This is so because the rider must negotiate many obstacles, including rocks, fallen trees, and various other debris. The activity is made even more difficult by the fact that mountain biking is performed on uneven terrain. Therefore, it is difficult to prepare for this activity without actually going out and doing it.

For traditional bicycling, on the other hand, there are many ways to achieve the fitness and skill level without actually going out on the road and riding. Specifically, there are countless exercise bikes on the market which can adequately prepare a rider for the activity. Those of ordinary skill in the art readily recognize such exercise equipment.

For the reasons stated previously herein, however, this same equipment is incomplete as a training tool for mountain bikers. While exercise bikes may prepare a rider aerobically, they fail to allow the rider to engage in the same types of activities and motions which the rider must do when mountain biking.

Attempts have been made to provide an effective training tool for mountain bikers. The most successful attempt consists of a design utilizing a bicycle frame having two legs resembling pogo sticks in lieu of wheels, with one leg supporting the front of the frame and the second supporting the rear of the frame. The frame supports handle bars and foot pegs. Through the handle bars and foot rests, the user applies downward force to the frame, causing each leg to compress. The legs react by extending, thereby causing a corresponding upward force on the frame and the user. This resembles the motion of a traditional pogo stick. This design is limited, however, in that it does not provide independent movement of the front and rear legs. Specifically, both legs must contact the ground simultaneously since the legs only work properly when impacted in a substantially horizontal manner.

Considering the limitations of existing equipment, it is clear that an effective training device is needed to adequately train mountain bikers without requiring the bikers to actually go riding. The following invention accomplishes these goals.

SUMMARY OF THE INVENTION

The invention is a training device for mountain bikers. The device provides a realistic simulation of the motions and acts which a rider must perform when engaged in this activity, utilizing a simple, effective, and durable design.

The design is essentially comprised of a bicycle frame without wheels. Instead of wheels, the device has two legs which are rotatably mounted to the frame. One of the legs extends in a diagonal direction to the front of the frame, while the second leg extends in a diagonal direction to the rear of the frame. Each leg is connected to a spring which, in turn, is connected to the frame. The springs act to restrict the motion of the legs and return each leg to their original position after an external force is exerted on them. Each leg further has a foot connected to it which contacts the ground.

The frame supports handle bars and two pedals for the placement of the user's feet. Each foot pedal is essentially a peg having a rough upper surface on which the user rests the sole of the shoes. The surface is made this way so as to provide enough friction to prevent slippage of the user's feet.

The handle bars have a soft rubber gripping portion for the placement of the user's hands. The frame, in turn, is supported by the legs.

There are two legs in all, one supporting the front portion of the frame and the second supporting the rear portion of the frame. In operation, the user of the device uses the foot pedals and the handle bars for support. The user then exerts a downward force on the frame of the device via the foot pedals and the handle bars.

This downward force cause the legs to rotate about the point at which they are attached to the frame, thereby compressing the springs. In response, the springs exert a corresponding force to extend the legs and, therefore, propel the bicycle frame and the user upward. Through this action, the user is able to "jump" from point to point while on the apparatus. Further, since there are only two legs, the user may jump the apparatus such that the legs contact the surface at various angles. The user may even go so far as to "jump" the invention on only one leg. This combination of the invention's capabilities realistically simulates the motions of a mountain bike being ridden on natural terrain in addition to providing the user with the means to practice maneuvers which must be performed when engaging in such an activity.

To further enhance the realism of the motion, the handle bars are rotatable much like that of a traditional mountain bike.

In addition to acting as a training device for mountain bikers, the present invention is an effective workout tool which stresses different muscles in ways that traditional workout equipment fail to. Specifically, the resultant impact caused by the use of the device places stress in the abdominals, back, arms, and shoulders of the user. Ordinary exercise bikes place little, if any, stress on these muscle groups. Further, the jumping motion occurring during use of the present invention places unique stresses on the quadriceps and calves of the user. Consequently, the present invention acts to increase the overall muscle strength of the user in addition to improving the user's cardiovascular fitness and balance.

To maximize the strength of the invention and minimize the weight, the majority of the components of the invention are preferrably composed of aluminum. However, in the preferred embodiment, the components subjected to the maximum stress and impact are composed of steel.

The invention, together with the various embodiments thereof, will be more fully explained by the accompanying drawings and the following descriptions.

DETAILED DESCRIPTION OF THE DRAWINGS

Figure 1:
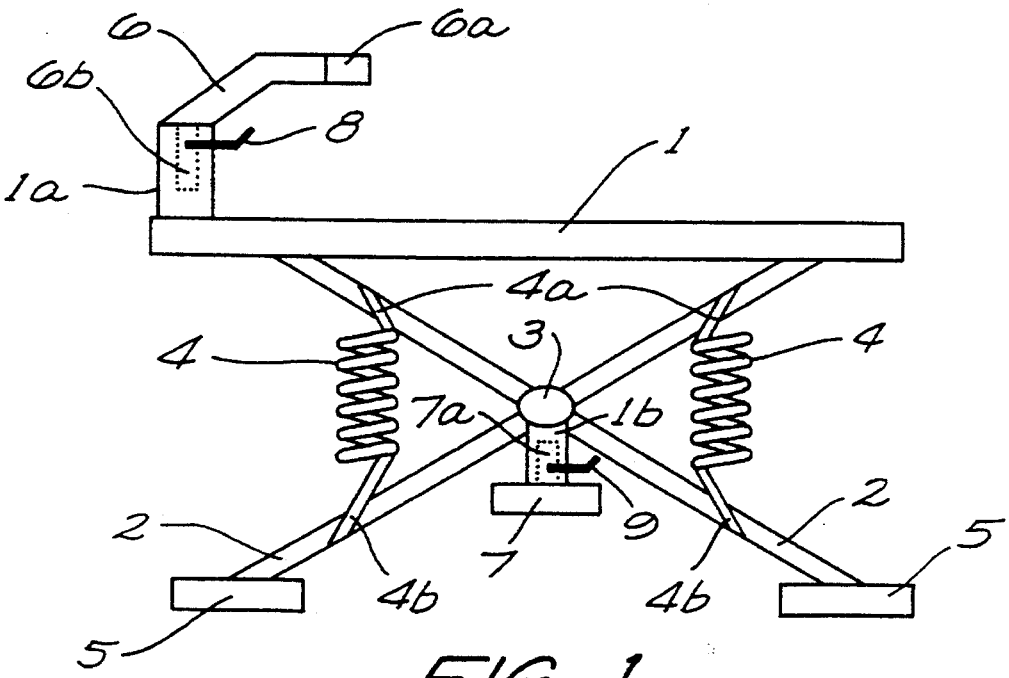
FIG. 1 is a side elevation view of the preferred embodiment of the invention showing the invention's major components and their relation to each other.

FIG. 1 shows a side view of the preferred embodiment of the invention.

Frame 1 is supported by legs 2. Each of legs 2 is oriented diagonally relative to frame 1, with one of legs 2 extending toward the front of frame 1 and another of legs 2 extending towards the rear of frame 1. Each of legs 2 is pivotally attached at hub 3 on frame 1. The motion of leg 2 is limited by spring 4 which, in the preferred embodiment, is a compression spring.

Spring 4 is attached to frame 1 via mounting bracket **4*a* and to leg 2 via mounting bracket 4*b*. The tension of spring 4 and, therefore, the range of motion of legs 2, may be adjusted be changing the relative mounting locations of springs 4. Those of ordinary skill in the art readily recognize ways of configuring mounting brackets 4*a* and 4*b*** to provide for this feature.

While the preferred embodiment uses springs 4 as the means for extending legs 2, alternative embodiments may use other means such as adjustable shock absorbers to accomplish this task. Those of ordinary skill in the art readily recognize shock absorbers suitable for this purpose.

On the end of leg 2 opposite the end which is pivotally attached at hub 3, exists foot 5 for contact with a ground surface. Foot 5 is composed of material sufficiently durable to withstand constant impact with the ground surface. Those of ordinary skill in the art readily recognize materials having such qualities and characteristics.

Figure 2:
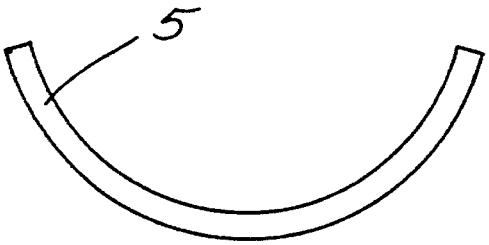
FIG. 2 is a detailed view of an alternative embodiment of the feet of the invention.

While the preferred embodiment depicts foot 5 as rectangular, those of ordinary skill in the art readily recognize alternative configurations. One such configuration is depicted in FIG. 2. In this embodiment, foot 5 is semicircular in shape. This provides foot 5 with a constant impact area when legs 2 impact the ground surface other than simultaneously. It further provides foot 5 with a sufficient impact area for impact at various angles. Those of ordinary skill in the art readily recognize methods of mounting foot 5 as depicted in this embodiment on legs 2.

FIG. **2*a* shows another alternative embodiment of foot 5. In this embodiment, foot 5 is a dome-shaped cap attached to leg 2. This, as in the previously described embodiment, provides foot 5 with a constant impact area when legs 2 are impacted other than simultaneously or at differing angles. Those of ordinary skill in the art readily recognize methods of mounting foot 5 as depicted in this embodiment on legs 2**.

As seen in FIG. 1, frame 1 further supports handle bars 6. Handle bars 6 have a gripping portion **6*a* for gripping by a user. In the preferred embodiment, gripping portion 6*a*** is made of a soft rubber for user comfort and further is conformed to the shape of a user's hands.

Handle bars 6 are adjustable in height. Handle bar 6 has peg **6*b* which inserts into mounting portion 1*a* of frame 1. Peg 6*b* has a series of holes through which adjustment pin 8 inserts. Therefore, the user merely adjusts handle bar 6 to the height desired and inserts pin 8 through a hole (not shown) in mounting portion 1*a* of frame 1 and through a corresponding hole in peg 6*b*. Those of ordinary skill in the art readily recognize alternative methods and designs of making the height of handle bars 6** adjustable.

In the preferred embodiment, handle bars 6 are pivotally attached to frame 1 so as to more effectively simulate a mountain biking scenario. However, as an alternative embodiment, handle bars 4 may be fixably attached to frame 1.

Figure 3:
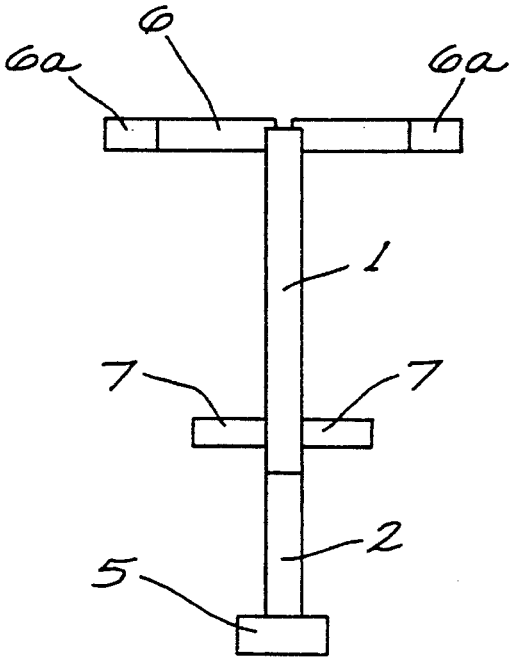
FIG. 3 is a front elevation view of the preferred embodiment of the invention showing the invention's major components and their relation to each other.
Figure 2A:
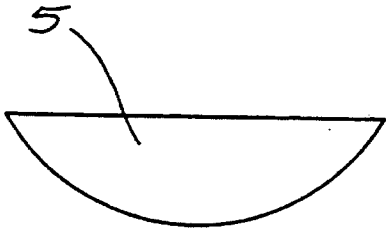
FIG. 2*a* is a detailed view of a second alternative embodiment of the feet of the invention.

Also supported by frame 1 are foot pedals 7. Each of foot pedals 7 consists of a single peg extending in a direction substantially perpendicular to frame 1. This is most clearly shown in FIG. 3, which is a frontal view of the preferred embodiment of the invention.

Foot pedals 7 further have a rough surface on their upper part. This surface is for contact with the sole of a user's shoes and provides sufficient friction to prevent loss of the user's footing.

Foot pedals 7 are adjustable in height. Shown in FIG. 1, foot pedals 7 each have peg **7*a* which inserts into mounting portion 1*b* of frame 1. Peg 7*a* has a series of holes through which adjustment pin 9 inserts. Therefore, the user merely adjusts foot pedals 7 to the height desired and inserts adjustment pin 9 through a hole (not shown) in mounting portion 1*b* of frame 1 and through a corresponding hole in peg 7*a*. Those of ordinary skill in the art readily recognize alternative methods and designs of making the height of foot pedals 7** adjustable.

In use, a user grips handle bars 6 via grips **6*a* and, using foot pedals 7 as contact points, exerts downward force on frame 1. Since frame 1 is supported by legs 2, this downward force exerts a corresponding force on legs 2, causing legs 2 to rotate about hub 3 and reduce the vertical distance between feet 5 and frame 1. This, in turn, causes compression of spring 4. Spring 4 then acts to extend legs 2 to their original positions, thereby producing an upward force on frame 1. The user may then "jump" the apparatus from location to location, thereby simulating a mountain biking situation and receiving a thorough workout. Further, since legs 2 are rotatably attached to frame 1 at hub 3**, the user may "jump" the apparatus on one leg at a time. This is a capability not possessed by the prior art which uses a pogo stick arrangement for each leg. Specifically, by utilizing such an arrangement, each individual leg reacts independent of the other. Conversely, designs using the prior art require that each leg be oriented substantially perpendicular and be impacted in such a way, thereby requiring coordinated compression. This limitation does not exist with the presently disclosed invention.

By jumping frame 1 from location to location, the user is working several muscles not worked on traditional exercise bikes. Specifically, the user's arms, shoulders, and back are receiving a workout from the repeated impact of legs 2 against a ground surface. Further, using the present invention, the user's legs are subjected to more stress in the quadriceps and calves than when using traditional exercise bikes. This results in increased muscle strength and endurance. Even more importantly, the use of the invention as described herein enhances the user's balance, something not accomplished with the vast majority of existing exercise equipment.

In order to minimize weight and maximize strength, the majority of the components of the preferred invention are composed of aluminum. Specifically, frame 1, legs 2, handle bars 6, and foot pedals 7 are composed of aluminum in the preferred embodiment. Feet 5 and springs 4, on the other hand, are composed of steel to maximize strength and durability. Those of ordinary skill in the art readily recognize alternative compositions of the invention's components.

Figure 4:
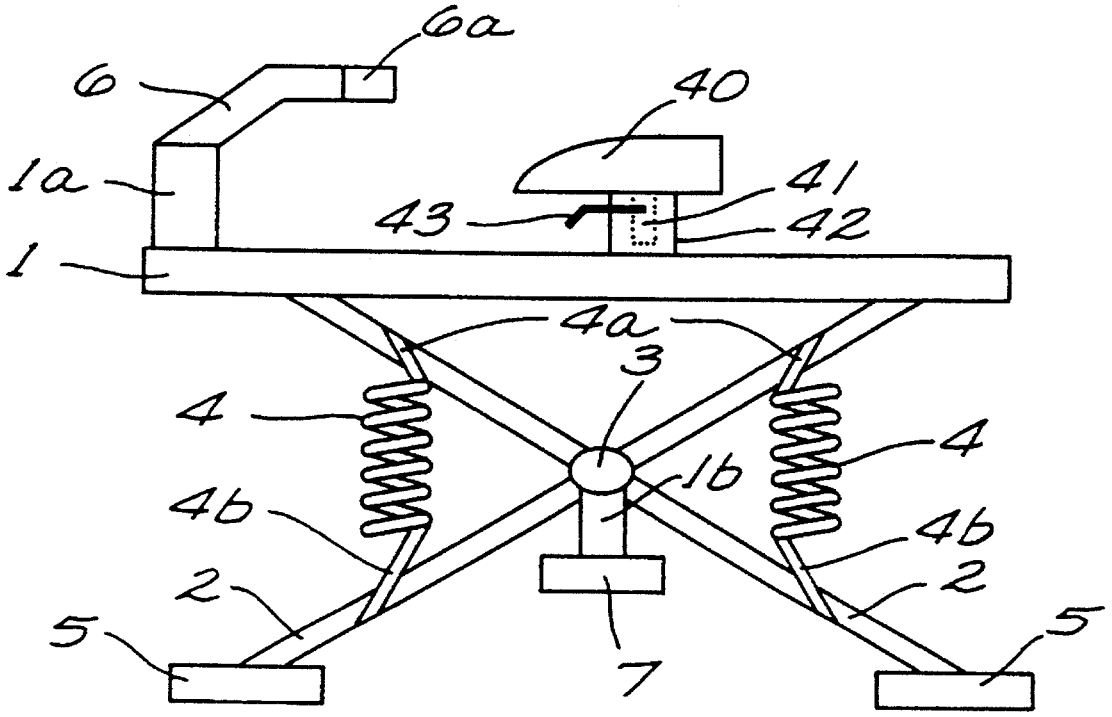
FIG. 4 is a side elevation view of an alternative embodiment of the invention showing the use of a seat to provide a means for the user to rest.

FIG. 4 is a side view of an alternative embodiment of the invention, showing the use of seat 40 for the user to rest on. It should be emphasized that the purpose of seat 40 in this embodiment is for rest purposes only, not for sitting while using the invention. Sitting while using the invention can cause physical injury to the user and is not recommended. Specifically, if seated, harmful stress is exerted on the spine of the user by the continuous and repeated impact caused by jumping with the invention. Therefore, even with seat 40, it is recommended that the user stand on foot pedals 5 and grip handle bars 4 and, only when resting, sit on seat 40.

In this embodiment, seat 40 is adjustable in height. Seat 40 has peg 41 which inserts into mounting portion 42 of frame 1. Peg 41 has a series of holes through which adjustment pin 43 inserts. Therefore, the user merely adjusts seat 40 to the height desired and inserts pin 43 through a hole (not shown) in mounting portion 42 of frame 1 and through the corresponding hole in peg 41. Those of ordinary skill in the art readily recognize alternative methods and designs of making the height of seat 40 adjustable.

Figure 5:
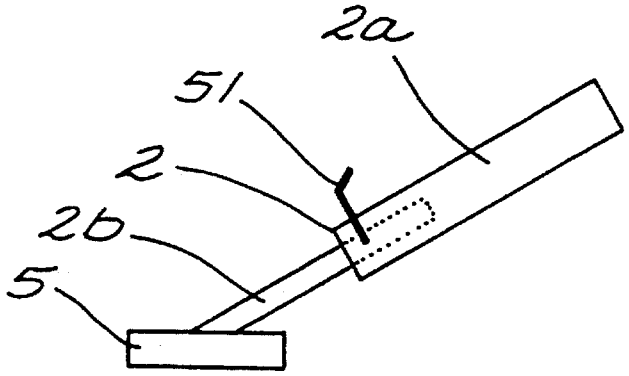
FIG. 5 is a side elevation view of an alternative embodiment of the invention showing the legs as being adjustable in length.

As an alternative, legs 2 are also adjustable as opposed to the fixed length of the preferred embodiment. This is best shown in FIG. 5 which is a detailed view of one of legs 2, showing how legs 2 may be configured to be adjustable in height. In this embodiment, leg 2 has two main components, upper member 2*a* and lower member 2*b*, which telescopes from upper member 2*a*. Lower member 2*b* has a series of holes through which pin 51 inserts. Therefore, the user merely adjusts leg 2 to the desired length and inserts pin 51 through a hole (not shown) in upper member 2*a* and through a corresponding hole in lower member 2*b*. Those of ordinary skill in the art readily recognize alternative methods and designs of making the length of legs 2 adjustable.

From the foregoing, it will be understood by those skilled in the art that the disclosed invention is a training device for mountain bikers capable of effectively simulating the motions and acts performed when engaged in such an activity. Further, the invention provides a unique and effective exercise means not matched by existing exercise equipment.

What is claimed is:

1. An exercise apparatus comprising:

a) a frame having a front portion, a middle portion, and a rear portion, said frame supporting a seat in an upper part of said middle portion and further supporting at least one footrest on each side of said frame in a lower part of said middle portion;

b) a handlebar means mounted to an upper part of said front portion of said frame;

c) at least two legs supporting said frame, each of said legs having a first and second end, said first end rotatably attached to said frame, said second end for contact with a ground surface, each of said legs oriented in a diagonal direction wherein the first end of each of said legs is connected to said frame at a common mounting mechanism; and, d) at least two expansion means, each expansion means connected to said frame and to one of said at least two legs, said expansion means expanding each of said legs to their extended positions.

2. The exercise apparatus according to claim 1 wherein each of said legs includes a means for extending the length of each said legs.

3. The exercise apparatus according to claim 2 wherein said means for extending includes a first leg member telescoping from a second leg member.

4. The exercise apparatus according to claim 1 wherein each of said at least two footrests extends from said common mounting mechanism.

5. The exercise apparatus according to claim 1 wherein each of said at least two footrests consists of a peg, said peg oriented substantially horizontal and extending substantially perpendicular from said frame.

6. The exercise apparatus according to claim 5 wherein said peg of each of said at least two footrests has a rough surface on its upper side, said surface for contact with the sole portion of a user's shoe.

7. The exercise apparatus according to claim 6 wherein each of said at least two footrests is adjustable in height.

8. The exercise apparatus according to claim 1 wherein said handlebar means has a gripping portion for placement of a user's hands.

9. The exercise apparatus according to claim 8 wherein said handlebar means is adjustable in height.

10. The exercise apparatus according to claim 1 wherein said expansion means consists of at least two springs, each spring having a first end connected to said frame and a second end connected to one of said at least two legs.

11. A training device for bicyclists comprising:

a) a bicycle frame having a handle bar means attached thereto;

b) at least two foot pedals supported by said bicycle frame, at least one of said foot pedals located on one side of said bicycle frame, at least one of said at least two foot pedals located on an opposite side of said bicycle frame;

c) at least two legs supporting said bicycle frame, each of said legs having a first and second end, said first end rotatably attached to said frame, said second end for contact with a ground surface, each of said legs oriented in a diagonal direction wherein the first end of each said legs is connected to said frame at a common mounting mechanism; and, d) at least two expansion means, each of said expansion means connected to said frame and to one of said legs, each of said expansion means rotating each of said legs to their extended positions.

12. The training device according to claim 11 wherein each of said legs includes means for adjusting the length of said legs.

13. The training device according to claim 12 wherein said means for adjusting includes a first leg member telescoping from a second leg member.

14. The training device according to claim 15 wherein each of said at least two foot pedals extends from said common mounting mechanism.

15. The training device according to claim 14 wherein each foot pedal has a rough surface on its upper side for contact with the sole portion of a user's shoe.

16. The training device according to claim 15 wherein each of said foot pedals is adjustable in height.

17. The training device according to claim 11 wherein said handle bar means is adjustable in height.

18. The training device according to claim 17 wherein said handle bar means has a gripping portion for placement of a user's hands.

19. The training device according to claim 18 wherein said handle bar means is pivotally attached to said bicycle frame.

20. The training device according to claim 11 wherein said expansion means consists of at least two springs, each spring having a first end connected to said frame and a second end connected to one of said at least two legs.

* * * * *